US012612767B2

(12) United States Patent
Seki et al.

(10) Patent No.: US 12,612,767 B2
(45) Date of Patent: Apr. 28, 2026

(54) WORK MACHINE ABNORMALITY DETERMINATION SYSTEM AND WORK MACHINE ABNORMALITY DETERMINATION METHOD

(71) Applicant: Komatsu Ltd., Tokyo (JP)

(72) Inventors: Yohei Seki, Tokyo (JP); Koji Kusaka, Tokyo (JP); Yuki Hosoda, Tokyo (JP)

(73) Assignee: KOMATSU LTD., Tokyo (JP)

( * ) Notice: Subject to any disclaimer, the term of this patent is extended or adjusted under 35 U.S.C. 154(b) by 218 days.

(21) Appl. No.: 18/279,999

(22) PCT Filed: Mar. 14, 2022

(86) PCT No.: PCT/JP2022/011338
§ 371 (c)(1),
(2) Date: Sep. 1, 2023

(87) PCT Pub. No.: WO2022/196639
PCT Pub. Date: Sep. 22, 2022

(65) Prior Publication Data

US 2024/0141625 A1 May 2, 2024

(30) Foreign Application Priority Data

Mar. 19, 2021 (JP) ..... 2021-046511

(51) Int. Cl.
*E02F 9/26* (2006.01)

(52) U.S. Cl.
CPC ..... *E02F 9/264* (2013.01)

(58) Field of Classification Search
CPC . E02F 9/264; E02F 3/434; E02F 9/261; E02F 9/267
See application file for complete search history.

(56) References Cited

U.S. PATENT DOCUMENTS

| | | | | |
|---|---|---|---|---|
| 11,508,091 | B2 | 11/2022 | Atsumi et al. | |
| 2017/0284071 | A1 | 10/2017 | Yamaguchi et al. | |
| 2019/0150357 | A1* | 5/2019 | Wu | H04N 7/188 |
| 2019/0277004 | A1 | 9/2019 | Hashimoto et al. | |
| 2019/0360176 | A1 | 11/2019 | Shimoda et al. | |

(Continued)

FOREIGN PATENT DOCUMENTS

| | | | |
|---|---|---|---|
| CN | 112334733 | A | 2/2021 |
| JP | 2017203322 | A | 11/2017 |
| JP | 2018-17617 | A | 2/2018 |

(Continued)

OTHER PUBLICATIONS

Supplemental European Search Report dated Dec. 23, 2024, issued in the corresponding European patent application No. 22771385.6.

*Primary Examiner* — Donald J Wallace
(74) *Attorney, Agent, or Firm* — Troutman Pepper Locke LLP

(57) ABSTRACT

An abnormality determination system applicable to a work machine includes: a stereo camera mounted on a wheel loader having working equipment; a position data calculation unit that estimates a position of the working equipment in a captured image of the stereo camera based on a posture of the working equipment when captured by the stereo camera; and a determination unit that determines whether the stereo camera is normal based on the estimated position of the working equipment.

15 Claims, 8 Drawing Sheets

(56) References Cited

U.S. PATENT DOCUMENTS

| | | | |
|---|---|---|---|
| 2020/0224391 | A1 | 7/2020 | Seki et al. |
| 2021/0209800 | A1 | 7/2021 | Atsumi et al. |

FOREIGN PATENT DOCUMENTS

| | | | |
|---|---|---|---|
| JP | 2018-28212 | A | 2/2018 |
| JP | 2019-132068 | A | 8/2019 |
| JP | 2021042569 | A | 3/2021 |

* cited by examiner

WORK MACHINE ABNORMALITY DETERMINATION SYSTEM AND WORK MACHINE ABNORMALITY DETERMINATION METHOD

FIELD

The present disclosure relates to a work machine abnormality determination system and a work machine abnormality determination method.

BACKGROUND

Patent Literature 1 discloses an example of a work machine capable of satisfactorily measuring a relative position with respect to a work target in order to implement automation of work by the work machine. In Patent Literature 1, a relative position between a wheel loader and a work target is measured based on measurement data obtained by a three-dimensional measurement device.

CITATION LIST

Patent Literature

Patent Literature 1: JP 2019-132068 A

SUMMARY

Technical Problem

In automation of work, it is desirable to measure the position of working equipment in a work machine with high accuracy. This leads to a demand for appropriately determining, at the start of work on the work machine, whether the three-dimensional measurement device used to measure the position of the working equipment is normal.

An object of an aspect of the present disclosure is to appropriately determine whether a three-dimensional measurement device used for measuring a position of the working equipment in a work machine is normal.

Solution to Problem

According to an aspect of the present invention, an abnormality determination system of a work machine, the system comprises: a camera mounted on the work machine having working equipment; a position calculation unit that estimates a position of the working equipment in a captured image of the camera based on a posture of the working equipment when captured by the camera; and a determination unit that determines whether the camera is normal based on the estimated position of the working equipment.

According to another aspect of the present invention, an abnormality determination method applicable to a work machine, the method comprises: estimating a position of working equipment in a captured image obtained by a camera mounted on the work machine including the working equipment based on a posture of the working equipment when captured by the camera; and determining whether the camera is normal based on the estimated position of the working equipment.

Advantageous Effects of Invention

According to the aspect of the present disclosure, it is possible to appropriately determine whether the three-dimensional measurement device used for measuring the position of the working equipment of the work machine is normal.

DESCRIPTION OF EMBODIMENTS

Hereinafter, embodiments according to the present disclosure will be described with reference to the drawings, but the present disclosure is not limited to the embodiments. The constituents described in the embodiments below can be appropriately combined with each other. In some cases, a portion of the constituents is not utilized. The abnormality determination system for a work machine is a system that appropriately determines, at the start of operation of the work machine equipment, whether a camera used to measure the position of working equipment 10 is normal. The abnormality determination system for a work machine is implemented by combining individual parts of the work machine.

Embodiment

[Wheel Loader]

Figure 1:
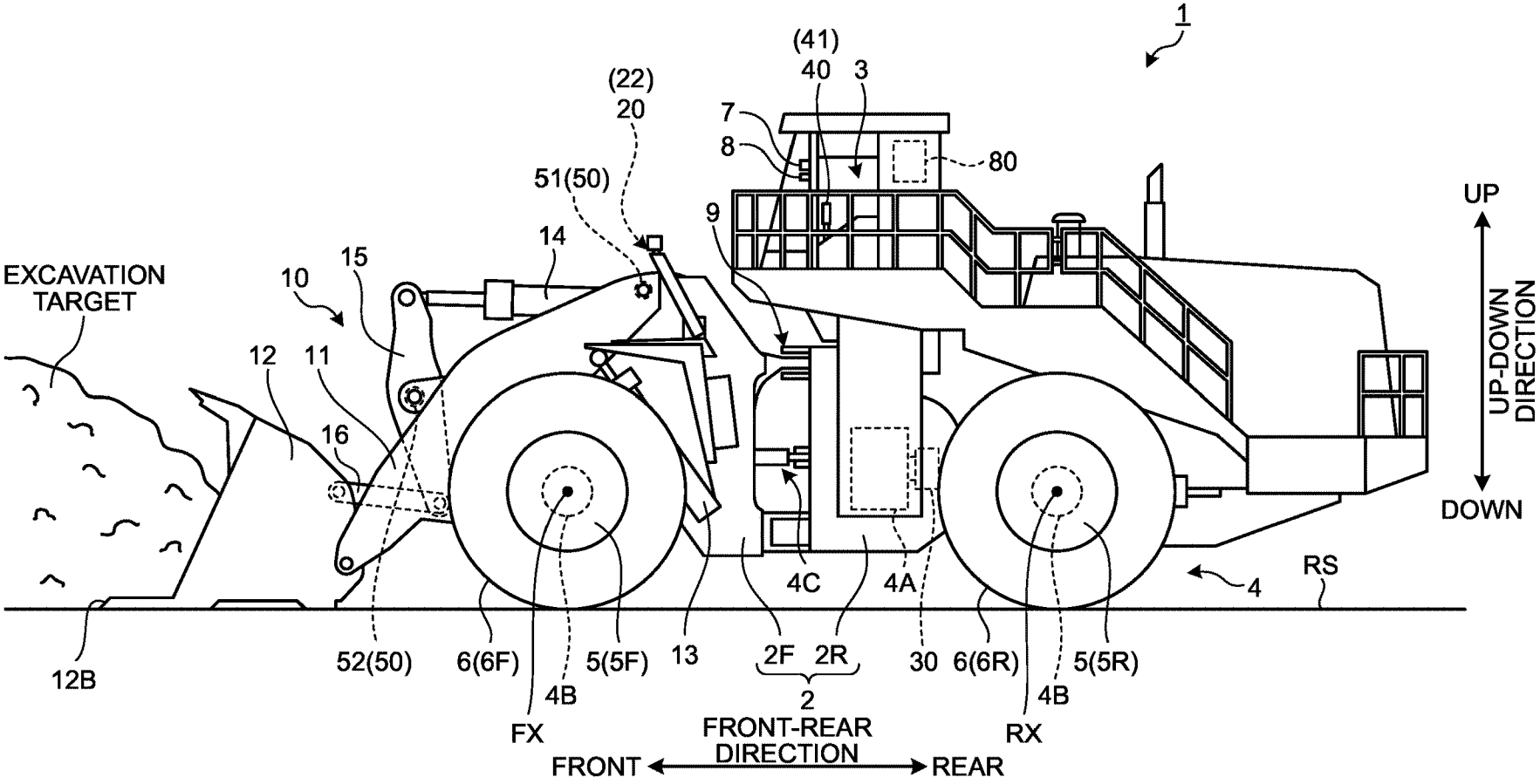
FIG. 1 is a side view illustrating an example of a work machine according to the present embodiment.

FIG. 1 is a side view illustrating an example of a wheel loader 1 according to the present embodiment. A work machine 1 performs predetermined work toward a work target at a work site. In the present embodiment, the work machine 1 will be described as a wheel loader 1, which is a type of an articulated work machine. The predetermined work includes excavation work and loading work. The work target includes an excavation target and a loading target onto which the excavated object is loaded. The wheel loader 1 performs excavation work, which is work of excavating an excavation target and loading work, which is work of loading an excavated object excavated by the excavation work onto the loading target. The loading work is a concept including discharging work of discharging the excavated object to a discharge target. The excavation target includes, for example, at least one of natural hill, crag, coal, and a wall surface. The natural hill is a hill formed of earth and sand, and a crag is a hill formed of a rock or a stone. The loading target includes, for example, at least one of a haul vehicle, a predetermined area of a work site, a hopper, a belt conveyor, and a crusher.

As illustrated in FIG. 1, the wheel loader 1 includes: a vehicle body 2; a cab 3 provided with a driver's seat; a traveling device 4 that causes the vehicle body 2 to travel; a transmission device 30; working equipment 10 supported by the vehicle body 2; an angle sensor 50 that detects an angle of the working equipment 10; a three-dimensional measurement device 20 that measures a work target in front of the vehicle body 2; a buzzer 7 provided around the cab 3; a lamp 8 provided around the cab 3; and a control device 80. The angle sensor 50 is an example of an angle detection unit. The three-dimensional measurement device 20 is an example of a camera.

The vehicle body 2 includes a vehicle body front portion 2F and a vehicle body rear portion 2R. The vehicle body front portion 2F and the vehicle body rear portion 2R are bendably connected to each other via a joint mechanism 9.

The cab 3 is supported by the vehicle body 2. At least a part of the wheel loader 1 is operated by a driver on the cab 3.

The traveling device 4 supports the vehicle body 2. The traveling device 4 can travel on a ground surface RS. The traveling device 4 has wheels 5. The wheels 5 are rotated by a driving force generated by an engine mounted on the vehicle body 2. The wheel 5 includes two front wheels 5F attached to the vehicle body front portion 2F and two rear wheels 5R attached to the vehicle body rear portion 2R. The wheels 5 are equipped with tires 6. The tires 6 include a front tire 6F attached to the front wheel 5F and a rear tire 6R attached to the rear wheel 5R. The front wheel 5F and the front tire 6F are rotatable about a rotation axis FX. The rear wheel 5R and the rear tire 6R are rotatable about the rotation axis RX. When the vehicle body 2 travels straight, the rotation axis FX and the rotation axis RX are parallel to each other.

In the following description, a direction parallel to the rotation axis FX of the front wheel 5F is appropriately referred to as a vehicle width direction. A direction orthogonal to the ground contact surface of the front tire 6F in contact with the ground surface RS is appropriately referred to as an up-down direction. A direction orthogonal to both the vehicle width direction and the up-down direction is appropriately referred to as a front-rear direction.

The traveling device 4 includes a driving device 4A, a braking device 4B, and a steering device 4C. The driving device 4A generates a driving force for accelerating the wheel loader 1. The driving device 4A includes an internal combustion engine such as a diesel engine, for example. The driving force generated by the driving device 4A is transmitted to the wheels 5 via the transmission device 30 to allow the wheels 5 to rotate. The braking device 4B generates a braking force for decelerating or stopping the wheel loader 1. The steering device 4C can adjust the traveling direction of the wheel loader 1. The traveling direction of the wheel loader 1 includes the direction of the vehicle body front portion 2F. The steering device 4C bends the vehicle body front portion 2F by a hydraulic cylinder, thereby adjusting the traveling direction of the wheel loader 1.

In the present embodiment, the traveling device 4 is operated by a driver on the cab 3. The cab 3 is equipped with a travel operation device 40 which is used to operate the traveling device 4. The driver operates the travel operation device 40 to activate the traveling device 4. The travel operation device 40 includes an accelerator pedal, a brake pedal, a steering lever, and a gear shift lever 41 for switching forward and backward movements. Operation on the accelerator pedal increases the traveling speed of the wheel loader 1. Operation on the brake pedal decreases the traveling speed of the wheel loader 1 or stops traveling of the wheel loader 1. Operation on the steering lever causes the wheel loader 1 to swing. Operation on the gear shift lever 41 switches forward or backward movement of the wheel loader 1.

The transmission device 30 transmits the driving force generated by the driving device 4A to the wheels 5.

The working equipment 10 is controlled by the control device 80. The working equipment 10 includes: a boom 11 pivotably connected to the vehicle body front portion 2F; and a bucket 12 pivotably connected to the boom 11.

The boom 11 is activated by power generated by a boom cylinder 13. Expansion or contraction of the boom cylinder 13 causes the boom 11 to perform a raising motion or a lowering motion. The boom cylinder 13 includes a boom control valve (not illustrated) that controls a flow rate and a direction of hydraulic oil supplied from a hydraulic pump (not illustrated).

The bucket 12 is a work member having a distal end 12B including a blade edge. The bucket 12 is disposed in front of the front wheel 5F. The bucket 12 is connected to a distal end of the boom 11. The bucket 12 is connected to a bucket cylinder 14 via a bell crank 15 and a link 16. The bucket 12 is activated by power generated by the bucket cylinder 14. The bucket cylinder 14 includes a bucket control valve (not illustrated) that controls the flow rate and the direction of the hydraulic oil supplied from the hydraulic pump. Expansion or contraction of the bucket cylinder 14 causes the bucket 12 to perform a dumping motion or a tilting motion. The dumping motion causes the excavated object in the bucket 12 to be discharged from the bucket 12. The tilting motion causes the bucket 12 to scoop up the excavated object.

The angle sensor 50 is mounted on the working equipment 10 and detects the posture of the working equipment 10. The angle sensor 50 detects an angle of the working equipment 10. The angle sensor 50 includes a boom angle sensor 51 that detects the angle of the boom 11 and a bucket angle sensor 52 that detects the angle of the bucket 12. The boom angle sensor 51 detects an angle of the boom 11 with respect to a reference axis of a vehicle body coordinate system defined in the vehicle body front portion 2F, for example. The bucket angle sensor 52 detects an angle of the bucket 12 with respect to the boom 11. The angle sensor 50 may be a potentiometer, a stroke sensor that detects a stroke of the hydraulic cylinder, an inertial measurement unit, or an inclinometer. Angle data indicating the angle of the working equipment 10 is output to a position data calculation unit 83 and a determination unit 91 described below.

The three-dimensional measurement device 20 is mounted on the wheel loader 1. The three-dimensional measurement device 20 measures a work target in front of the vehicle body front portion 2F. The three-dimensional measurement device 20 measures the relative position from the three-dimensional measurement device 20 to each of a plurality of measurement points on the surface of the work target, thereby measuring the three-dimensional shape of the work target. The control device 80 calculates a parameter related to the work target based on the measured three-dimensional shape of the work target. As described below, in a case where the work target is a loading target, the parameter related to the loading target includes at least one of the distance to the loading target, the position of the upper end of the loading target, and the height of the loading target.

The three-dimensional measurement device 20 includes a stereo camera 22 which is a type of a photographic measurement device. The stereo camera 22 is disposed on either side, namely, the right side and the left side in the vehicle width direction of the vehicle body 2. In the following description, the stereo camera 22 on one side will be described.

The stereo camera 22 captures an image of the front. The stereo camera 22 captures an image of a work target and measures a work target. In the present embodiment, the stereo camera 22 measures a work target including at least a loading target such as a haul vehicle LS. The measurement data of the stereo camera 22 includes image data of a work target. The image data includes a plurality of pixels. The image data is an example of measurement data.

The stereo camera 22 includes a first camera 22A and a second camera 22B, as a pair of cameras. The first camera 22A and the second camera 22B are spaced apart from each other. First image data acquired by the first camera 22A and second image data acquired by the second camera 22B are output to the control device 80. The first image data and the second image data are two-dimensional image data.

The buzzer 7 is disposed in the vicinity of the cab 3. The buzzer 7 is a buzzer device that outputs a warning sound. The buzzer 7 outputs a determination result of the determination unit 91. In a case where the determination unit 91 determines that there is an abnormality, the buzzer 7 outputs a warning sound.

The lamp 8 is disposed in the vicinity of the cab 3. The lamp 8 outputs a determination result of the determination unit 91. In a case where the determination unit 91 has made a determination of normality, the lamp 8 sets the warning lamp to be steady-on. In a case where the determination unit 91 has made a determination of abnormality, the lamp 8 is set to allow a warning lamp to blink on/off.

[Operation]

Figure 2:
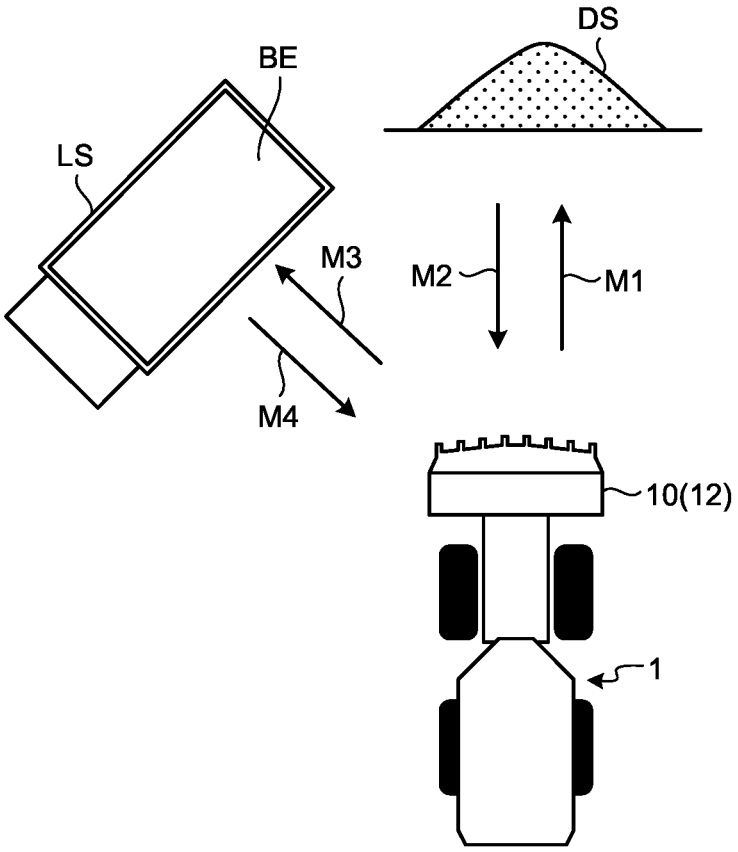
FIG. 2 is a schematic diagram illustrating motions of the work machine according to the present embodiment.

FIG. 2 is a schematic diagram illustrating operation of the wheel loader 1 according to the present embodiment. The wheel loader 1 works in a plurality of work modes. The work mode includes: an excavation work mode in which the bucket 12 of the working equipment 10 excavates an excavation target; and a loading work mode in which the excavated object scooped up by the bucket 12 in the excavation work mode is loaded onto a loading target. An example of the excavation target is a natural hill DS on the ground surface RS. An example of the loading target is a vessel BE of the haul vehicle LS capable of traveling on the ground surface RS. An example of the haul vehicle LS is a dump truck.

In the excavation work mode, the wheel loader 1 advances toward the natural hill DS in a state where the excavated object is not held by the bucket 12. The driver operates the travel operation device 40 to move the wheel loader 1 forward to approach the natural hill DS as indicated by an arrow M1 in FIG. 2. The control device 80 controls the working equipment 10 to excavate the natural hill DS by the bucket 12. This causes the natural hill DS to be excavated by the bucket 12, and causes the excavated object to be scooped up by the bucket 12.

The wheel loader 1 moves backward so as to be separated away from the natural hill DS in a state where the excavated object is held by the bucket 12. The driver operates the travel operation device 40 to move the wheel loader 1 backward and separate the wheel loader 1 from the natural hill DS as indicated by an arrow M2 in FIG. 2.

Next, a loading work mode is implemented. In the loading work mode, the wheel loader 1 advances toward the haul vehicle LS in a state where the excavated object is held by the bucket 12. The driver operates the travel operation device 40 to move the wheel loader 1 forward with swing operation to approach the haul vehicle LS as indicated by an arrow M3 in FIG. 2. At this time, the three-dimensional measurement device 20 mounted on the wheel loader 1 measures the haul vehicle LS. The control device 80 controls the working equipment 10 so as to load the excavated object held by the bucket 12 onto the vessel BE of the haul vehicle LS based on the measurement data of the three-dimensional measurement device 20. That is, the control device 80 controls the working equipment 10 to cause the boom 11 to take a raising motion in a state where the wheel loader 1 moves forward so as to approach the haul vehicle LS. After the boom 11 takes a raising motion and the bucket 12 is disposed above the vessel BE, the control device 80 controls the working equipment 10 to allow the bucket 12 to take a tilting motion. The excavated object is discharged from the bucket 12, which has taken the tilting motion, and then loaded on the vessel BE.

After the excavated object is loaded onto the vessel BE, the wheel loader 1 moves backward so as to be separated from the haul vehicle LS in a state where the excavated object is not held by the bucket 12. The driver operates the travel operation device 40 to move the wheel loader 1 backward with swing operation to be separated away from the haul vehicle LS as indicated by an arrow M4 in FIG. 2.

The driver and the control device 80 repeat the above operations until the vessel BE is fully loaded with the excavated object or the excavation of the natural hill DS is completed.

Figure 3:
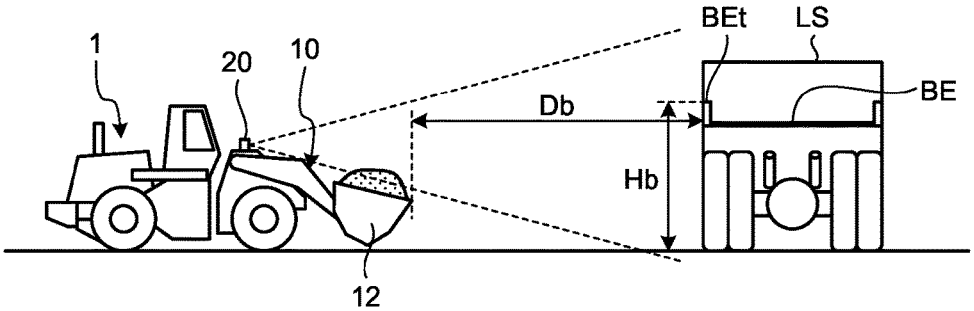
FIG. 3(A), FIG. 3(B) and FIG. 3(C) are schematic diagrams illustrating a loading work mode of the work machine according to the present embodiment.
Figure 3:
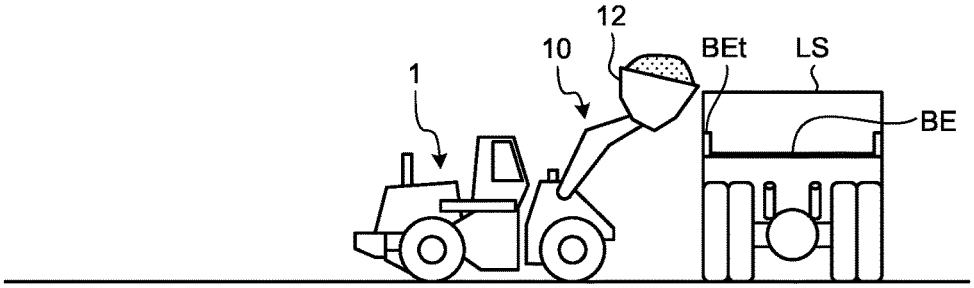
Figure 3:
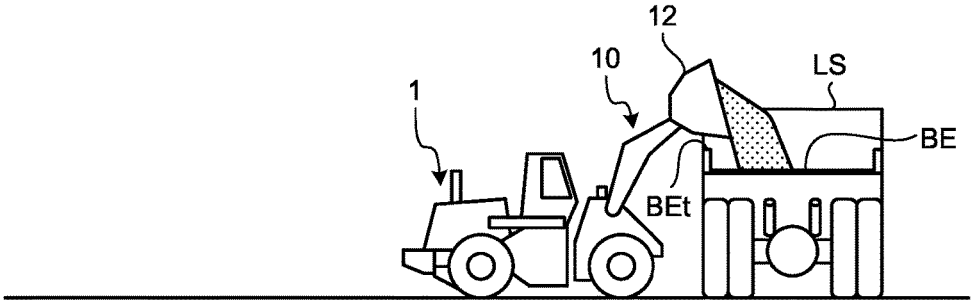

FIG. 3(A), FIG. 3(B) and FIG. 3(C) are schematic diagrams illustrating a loading work mode of the wheel loader 1 according to the present embodiment. The driver operates the travel operation device 40 to move the wheel loader 1 forward with swing operation to approach the haul vehicle LS. As illustrated in FIG. 3(A), the three-dimensional measurement device 20 measures the three-dimensional shape of the haul vehicle LS and the relative position with respect to the haul vehicle LS. Based on the measurement data obtained by the three-dimensional measurement device 20, the control device 80 detects a distance Db between the wheel loader 1 and the haul vehicle LS together with a height Hb of an upper end BEt of the vessel BE.

As illustrated in FIG. 3(B), in a state where the wheel loader 1 is moving forward to approach the haul vehicle LS, the control device 80 controls the boom 11 to take a raising motion while controlling the angle of the bucket 12 so that the bucket 12 is disposed above the upper end BEt of the vessel BE and the excavated object held by the bucket 12 does not spill from the bucket 12 based on the measurement data of the three-dimensional measurement device 20.

As illustrated in FIG. 3(C), after the boom 11 takes the raising motion to set the bucket 12 above the vessel BE, the control device 80 controls the working equipment 10 to cause the bucket 12 to take a dumping motion. With this control, the excavated object is discharged from the bucket 12 and then loaded into the vessel BE.

After the state of FIG. 3(C), the driver operates the travel operation device 40 to move the wheel loader 1 backward with swing operation to be separated away from the haul vehicle LS.

[Control Device]

Figure 4:
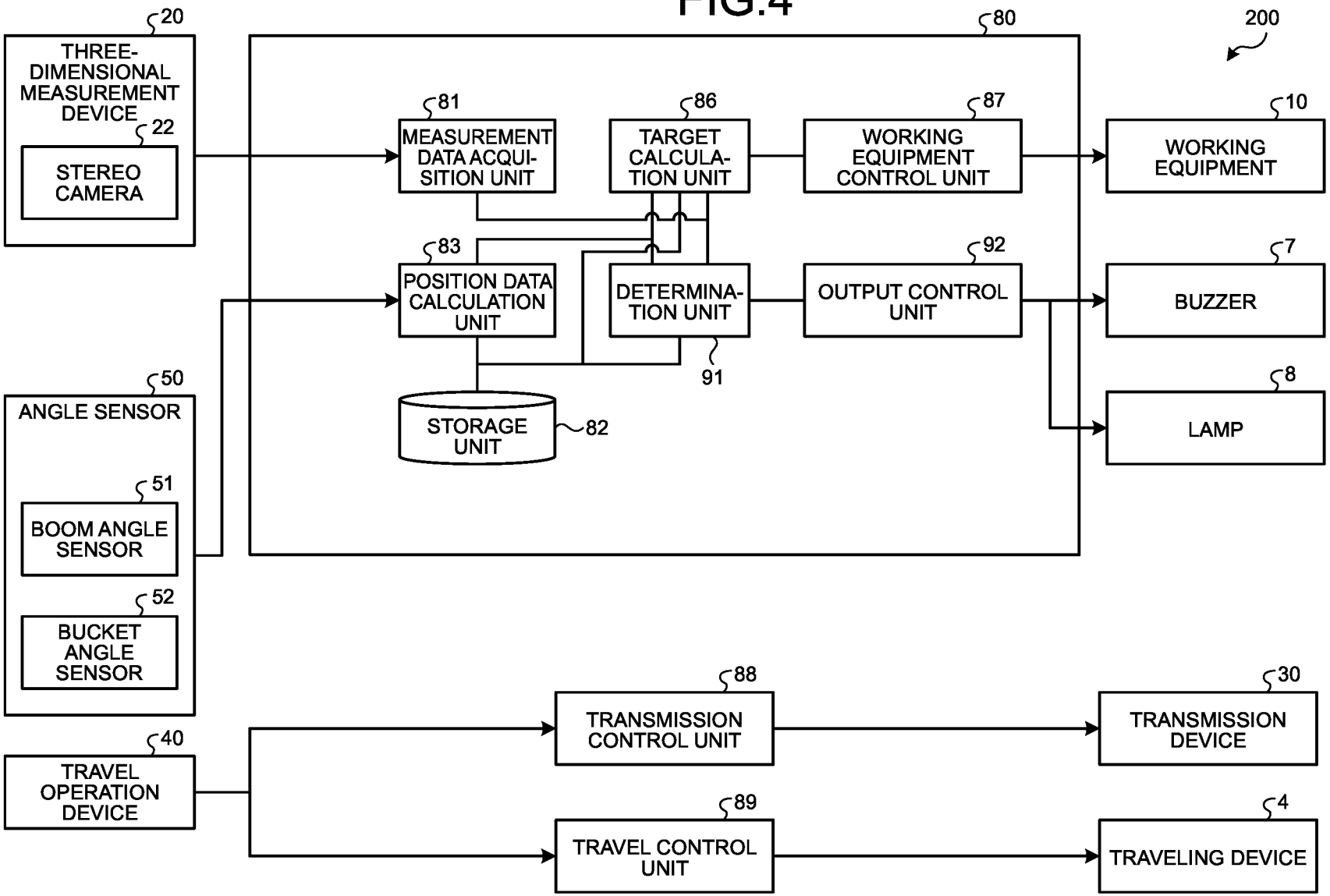
FIG. 4 is a functional block diagram illustrating a control system of a work machine according to the present embodiment.

FIG. 4 is a functional block diagram illustrating a control system 200 of the wheel loader 1 according to the present embodiment. The control device 80 includes a computer system. The control device 80 controls the wheel loader 1.

The control device 80 is connected to the working equipment 10, the three-dimensional measurement device 20, the angle sensor 50, the travel operation device 40, the buzzer 7, and the lamp 8. The control device 80 includes a measurement data acquisition unit 81, a storage unit 82, a position data calculation unit 83, a target calculation unit 86, a working equipment control unit 87, a determination unit 91, and an output control unit 92. The buzzer 7 is an example of an output unit. The lamp 8 is an example of an output unit. The position data calculation unit 83 is an example of a position calculation unit.

The control system 200 is an example of an abnormality determination system. The control system 200 includes the working equipment 10, the three-dimensional measurement device 20, the angle sensor 50, the travel operation device 40, the buzzer 7, the lamp 8, and the control device 80.

The measurement data acquisition unit 81 acquires measurement data of the three-dimensional measurement device 20. In the present embodiment, the measurement data acquisition unit 81 acquires the first image data from the first camera 22A of the stereo camera 22, and acquires the second image data from the second camera 22B. The image data of the work target acquired by the measurement data acquisition unit 81 is output to the target calculation unit 86 and the determination unit 91.

The storage unit 82 stores working equipment data. The working equipment data is data regarding the working equipment 10, which specifically includes: design data including computer aided design (CAD) data; or specification data, for example. The working equipment data includes outer shape data including dimensional data of the working equipment 10.

In the present embodiment, the working equipment data includes a boom length, a bucket length, and a bucket outer shape. The boom length refers to a distance between the boom rotation axis and the bucket rotation axis. The bucket length refers to a distance between the bucket rotation axis and the distal end 12B of the bucket 12. The boom rotation axis refers to a rotation axis of the boom 11 with respect to the vehicle body front portion 2F, and includes a connecting pin that connects the vehicle body front portion 2F and the boom 11 to each other. The bucket rotation axis refers to a rotation axis of the bucket 12 with respect to the boom 11, and includes a connecting pin that connects the boom 11 and the bucket 12 to each other. The bucket outer shape includes the shape and dimensions of the bucket 12. The dimensions of the bucket 12 include a bucket width indicating a distance between a left end and a right end of the bucket 12, a height of an opening of the bucket 12, a bucket bottom surface length, and the like.

The dimensional data of the bucket 12 is data that defines the outer shape of the bucket 12. In the present embodiment, the dimensional data is position data representing a plurality of positions on the outer periphery of the bucket 12. The dimensional data represents position data regarding five positions on the outer periphery of the bucket 12, for example.

Figure 5:
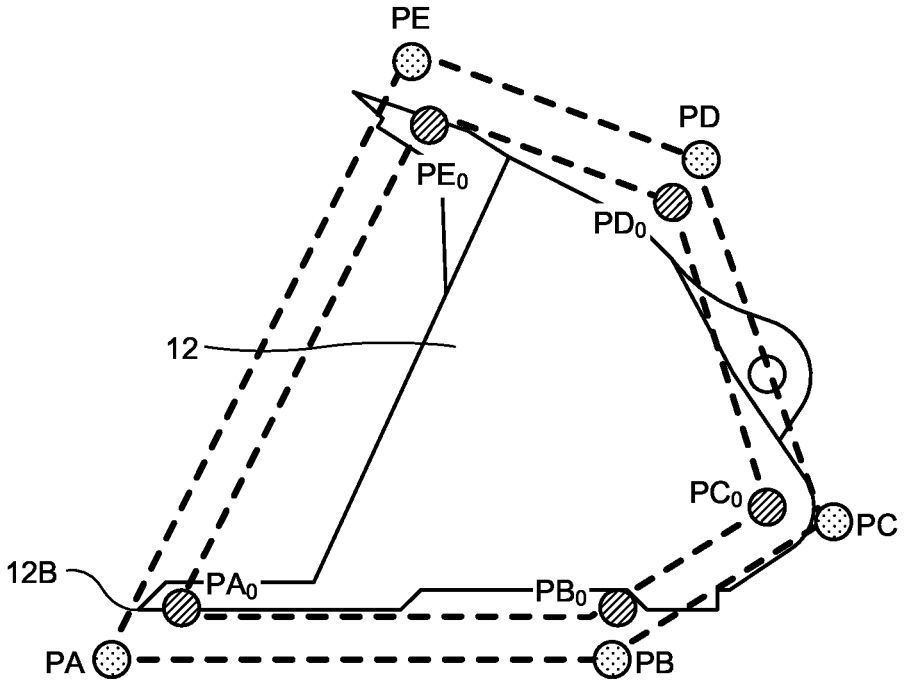
FIG. 5 is a diagram illustrating an example of dimensional data of working equipment of the work machine according to the present embodiment.

FIG. 5 is a diagram illustrating an example of dimensional data of the bucket 12 of the wheel loader 1 according to the present embodiment. In the present embodiment, the dimensional data of the bucket 12 is position data of five points $PA_0$, $PB_0$, $PC_0$, $PD_0$, and $PE_0$ on the outer periphery of the bucket 12. The shape connecting the points $PA_0$, $PB_0$, $PC_0$, $PD_0$, and $PE_0$ is a pentagon. Points PA, PB, PC, PD, and PE are set by enlarging a pentagon in consideration of a measurement error of each point. The bucket 12 is located inside a pentagon surrounded by the points PA, PB, PC, PD, and PE.

The position data calculation unit 83 calculates position data indicating the posture of the working equipment 10 based on the detection result from the angle sensor 50. More specifically, the position data calculation unit 83 calculates the position data of the working equipment 10 based on the angle data of the working equipment 10 detected by the angle sensor 50 and the working equipment data of the working equipment 10 stored in the storage unit 82. The position data of the working equipment 10 includes position data of each portion of the bucket 12 in the vehicle body coordinate system, for example. The position data of the working equipment 10 calculated by the position data calculation unit 83 is output to the determination unit 91.

The position data calculation unit 83 estimates the position of the working equipment 10 in the captured image obtained by the stereo camera 22 based on the posture of the working equipment 10 when captured by the stereo camera 22.

An example of a method of estimating the position of the working equipment 10 in the captured image will be described. The position data calculation unit 83 calculates the three-dimensional position of the working equipment 10 in the vehicle body coordinate system using the boom angle sensor 51 that detects the angle of the boom 11, the bucket angle sensor 52 that detects the angle of the bucket 12, and the dimensional data of the working equipment 10. The position data calculation unit 83 performs coordinate transformation of the three-dimensional position of the working equipment 10 in the vehicle body coordinate system to calculate the three-dimensional position of the working equipment 10 in the camera coordinate system. Note that the camera coordinate system is defined individually for the first camera 22A and the second camera 22B of the stereo camera 22. The camera coordinate system is a coordinate system based on the origin fixed individually for the first camera 22A and the second camera 22B. The position data calculation unit 83 performs transformation of the three-dimensional position of the working equipment 10 in the camera coordinate system to the projection planes of the first camera 22A and the second camera 22B obtained from the mounting position of the stereo camera 22, making it possible to estimate the position of the working equipment 10 in the captured image. An example of a method that can be used for transformation to the projection plane is a perspective projection method. Note that estimation of the position of the working equipment 10 may be estimated in the captured image of either one of the first camera 22A or the second camera 22B.

The target calculation unit 86 calculates three-dimensional data of the work target measured by the stereo camera 22 based on the measurement data acquired by the measurement data acquisition unit 81. The work target is the haul vehicle LS including the vessel BE. The three-dimensional data of the work target indicates the three-dimensional shape of the haul vehicle LS.

The target calculation unit 86 performs image processing on the image data acquired by the first camera 22A and the image data acquired by the second camera 22B based on the principle of triangulation, thereby measuring the three-dimensional shape of the work target. The target calculation unit 86 performs stereo processing on the first image data and the second image data, which are image data, to calculate distances from the stereo camera 22 to a plurality of measurement points on the surface of the work target captured in each pixel. The target calculation unit 86 calculates, for example, three-dimensional data in the vehicle body coordinate system based on the distance to each measurement point.

In the present embodiment, the target calculation unit 86 calculates parameters related to the haul vehicle LS based on the three-dimensional data of the haul vehicle LS. The parameters related to the haul vehicle LS include the position (height) of the upper end BEt of the haul vehicle LS (vessel BE) based on the ground surface RS, and the distance db from the wheel loader 1 to the haul vehicle LS. The distance db from the wheel loader 1 to the haul vehicle LS is a distance between the distal end 12B of the bucket 12 and a nearest point indicating a portion of the haul vehicle LS closest to the distal end 12B of the bucket 12 in the horizontal direction, for example.

Based on the three-dimensional data of the work target calculated by the target calculation unit 86, the working equipment control unit 87 controls the motion of the working equipment 10 that loads the excavated object into the work target. In the present embodiment, the working equipment control unit 87 controls the motion of the working equipment 10 to load the excavated object onto the vessel BE based on the calculated three-dimensional data of the haul vehicle LS. The working equipment control unit 87 controls the motion of the working equipment 10 to load the excavated object onto the vessel BE based on the height data indicating the height Hb of the upper end BEt of the vessel BE and the distance data indicating the distance db from the wheel loader 1 to the haul vehicle LS.

The control of the operation of the working equipment 10 by the working equipment control unit 87 includes control of the operation of at least one of the boom cylinder 13 and the bucket cylinder 14. More specifically, the working equipment control unit 87 outputs a control signal to the boom control valve to control the flow rate and direction of the hydraulic oil to be supplied to the boom cylinder 13, thereby controlling the raising/lowering motion of the boom 11. The working equipment control unit 87 outputs a control signal to the bucket control valve to control the flow rate and direction of the hydraulic oil to be supplied to the bucket cylinder 14, thereby controlling the raising/lowering motion of the bucket 12.

In the present embodiment, the wheel loader 1 includes a transmission control unit 88 and a travel control unit 89.

The transmission control unit 88 outputs a control signal for controlling the transmission device 30.

The travel control unit 89 controls the motion of the traveling device 4 based on the operation on the travel operation device 40 by the driver. The travel control unit 89 outputs a driving command for activating the traveling device 4. The travel control unit 89 outputs an accelerator command for activating the driving device 4A. The travel control unit 89 outputs a braking command for operating the braking device 4B. The travel control unit 89 outputs a steering command for activating the steering device 4C.

The determination unit 91 determines whether the stereo camera 22 is normal based on the position of the working equipment 10 estimated by the position data calculation unit 83. More specifically, the determination unit 91 determines whether the stereo camera 22 is normal based on the position of the working equipment 10 in the captured image estimated by the position data calculation unit 83 and the actual position of the working equipment 10 in the captured image captured by the stereo camera 22. In a case where the estimated position of the working equipment 10 in the captured image matches the actual position of the working equipment 10 in the captured image captured by the stereo camera 22, or in a case where the deviation is within a predetermined range, the determination unit 91 determines that the stereo camera 22 is normal. In a case where the estimated position of the working equipment 10 in the captured image does not match the actual position of the working equipment 10 in the captured image captured by the stereo camera 22, or in a case where the deviation is outside the predetermined range, the determination unit 91 determines that the stereo camera 22 is not normal.

Another determination method using the determination unit 91 will be described. The position of the working equipment 10 in the captured image captured by the stereo camera 22 is stored in the storage unit 82 in association with the posture of the working equipment 10. The position data calculation unit 83 acquires the position of the working equipment 10 in the captured image from the storage unit 82 from the posture of the working equipment 10 when the stereo camera 22 captures the image. Acquisition of the position of the working equipment 10 in the captured image from the storage unit 82 is an example of estimation of the position of the working equipment. Based on the posture of the working equipment 10 when captured by the stereo camera 22, the determination unit 91 may compare the position of the working equipment 10 in the captured image acquired from the storage unit 82 with the actual position of the working equipment 10 in the captured image captured by the stereo camera 22 to determine whether the stereo camera 22 is normal. Note that the position of the working equipment 10 in the captured image captured by the stereo camera 22 may be stored in the storage unit 82 in association with the combination of the dimensional data of each portion of the working equipment 10 and the position of the working equipment 10.

Figure 6:
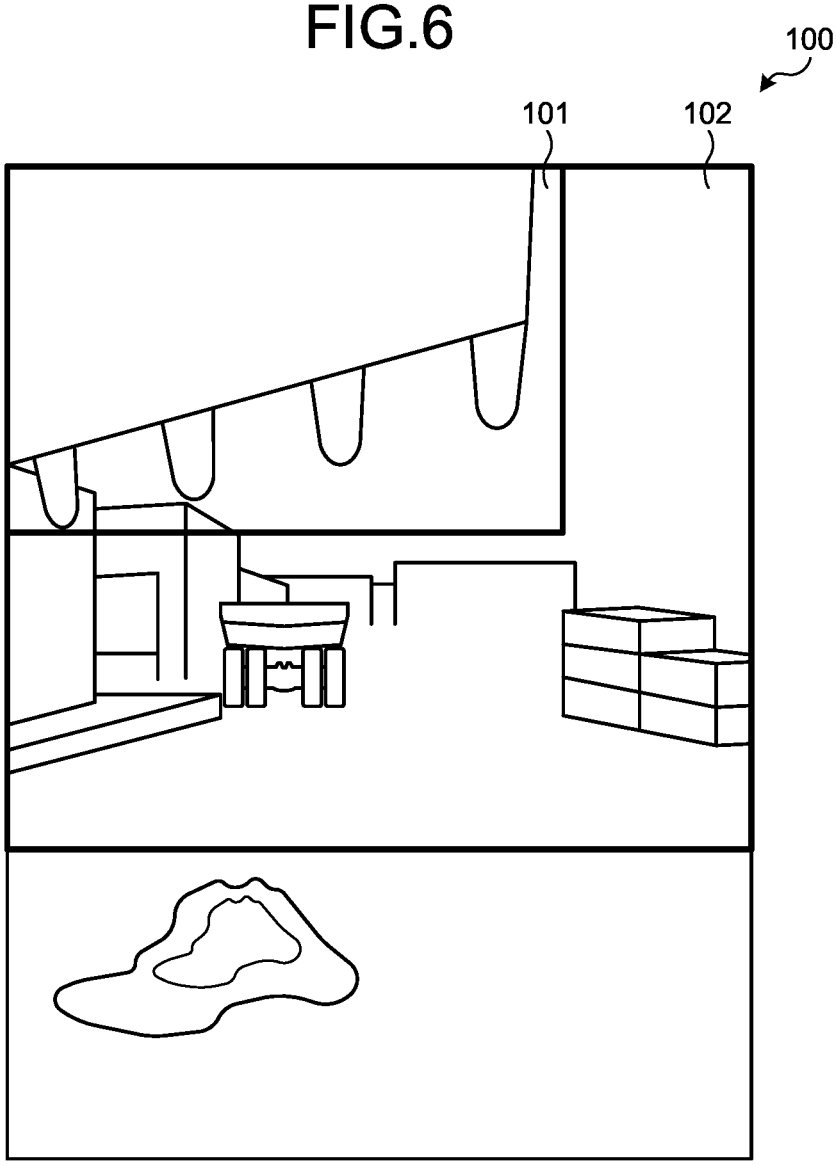
FIG. 6 is a diagram illustrating an example of image data acquired by a stereo camera.

A determination method used by the determination unit 91 will be described in detail with reference to FIG. 6. FIG. 6 is a diagram illustrating an example of image data 100 captured by the stereo camera 22. A range in which the bucket 12 is captured in the image data 100 can be defined according to the position of the bucket 12. More specifically, the determination unit 91 first performs image processing such as pattern matching on the image data 100 to recognize the bucket 12. Subsequently, the determination unit 91 counts the number of pixels of the bucket 12 in the range of the position of the working equipment 10 estimated by the position data calculation unit 83 and the number of pixels of the bucket 12 in the range outside the estimated position of the working equipment 10. In a case where the number of pixels of the bucket 12 within the range is equal to or greater than a threshold, the determination unit 91 determines that the camera is normal. In a case where the number of pixels of the bucket 12 within the range is less than the threshold, the determination unit 91 determines that the camera is abnormal. For example, in the image data 100 illustrated in FIG. 6, the estimated position of the bucket 12 is in a region 101. In other words, in the image data 100, the bucket 12 is indicated by pixels within the region 101.

In the present embodiment, the determination unit 91 may make the determination in a case where the working equipment 10 is present within a predetermined region A1 and within a predetermined angle A2. The image data 100 includes the ground surface RS, surrounding objects, or the working equipment 10, for example. This is to prevent occurrence of erroneous determination based on image data obtained when an object other than the working equipment 10 has been detected.

Figure 7:
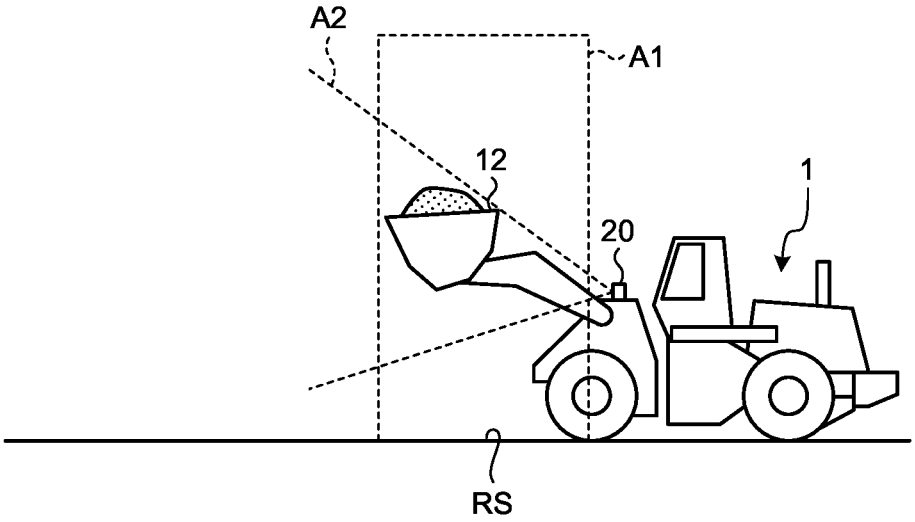
FIG. 7 is a diagram illustrating a predetermined region and a predetermined angle range of the working equipment in the work machine.

FIG. 7 is a diagram illustrating the predetermined region A1 and the predetermined angle range A2 of the working equipment 10 of the wheel loader 1. In the present embodiment, the determination unit 91 makes a determination in a case where the bucket 12 is present within the predetermined region A1 and within the predetermined angle range A2. The determination unit 91 makes a determination in a case where the bucket 12 is present within the predetermined region A1 on the front side of the wheel loader 1 and in a case where the angle of the bucket 12 is within the predetermined angle range A2. On the wheel loader 1 side of the predetermined region A1, the vehicle body 2 might be detected as false positive. On the farther side of the predetermined region A1, buildings and obstacles around the work site might be detected as false positive. In a case where the angle of the bucket 12 is outside the predetermined angle range A2, the bucket 12 would not be captured in image data.

In the present embodiment, the determination unit 91 may determine whether the positional relationship of the working equipment 10 based on the stereo camera 22 and the angle sensor 50 is normal. In other words, the determination unit 91 may determine whether the positional relationship of the working equipment 10 based on the stereo camera 22 and the angle sensor 50 is normal.

For example, in a case where it is determined that the positional relationship of the working equipment 10 based on the stereo camera 22 and the angle sensor 50 is normal, this indicates that all conditions are satisfied, specifically, the mounting posture of the stereo camera 22 as a unit is appropriate, the relative posture of the stereo camera 22 between the first camera 22A and the second camera 22B is appropriate, the mounting postures of the boom angle sensor 51 and the bucket angle sensor 52 of the angle sensor 50 are appropriate, and the dimensional data has been appropriately input.

For example, in a case where it is determined that the positional relationship of the working equipment 10 based on the stereo camera 22 and the angle sensor 50 is abnormal, this indicates that the factor of abnormality corresponds to at least one of the following: occurrence of deviation in the mounting posture of the stereo camera 22 as a unit; occurrence of deviation in the relative posture of the stereo camera 22 between the first camera 22A and the second camera 22B; occurrence of deviation in the mounting posture of the boom angle sensor 51 or the bucket angle sensor 52 of the angle sensor 50; or incorrect dimensional data.

The determination unit 91 performs the above-described determination processing on each of the stereo camera 22 on the right side and the stereo camera 22 on the left side. In a case where it is determined that both the right stereo camera 22 and the left stereo camera 22 are abnormal, it can be determined that there is an abnormality in a portion other than the stereo camera 22. In a case where it is determined that there is an abnormality in either the right stereo camera 22 or the left stereo camera 22, it can be determined that there is an abnormality in the stereo camera 22.

The output control unit 92 controls to output the determination result of the determination unit 91. In a case where the determination unit 91 determines that there is an abnormality, the output control unit 92 controls to output a warning sound from the buzzer 7. In a case where the determination unit 91 determines that there is an abnormality, the output control unit 92 controls the lamp 8 to blink on/off. In a case where the determination unit 91 determines that the camera is normal, the output control unit 92 controls to turn the lamp 8 to steady-on.

[Abnormality Determination Method in Start-Up Inspection]

Figure 8:
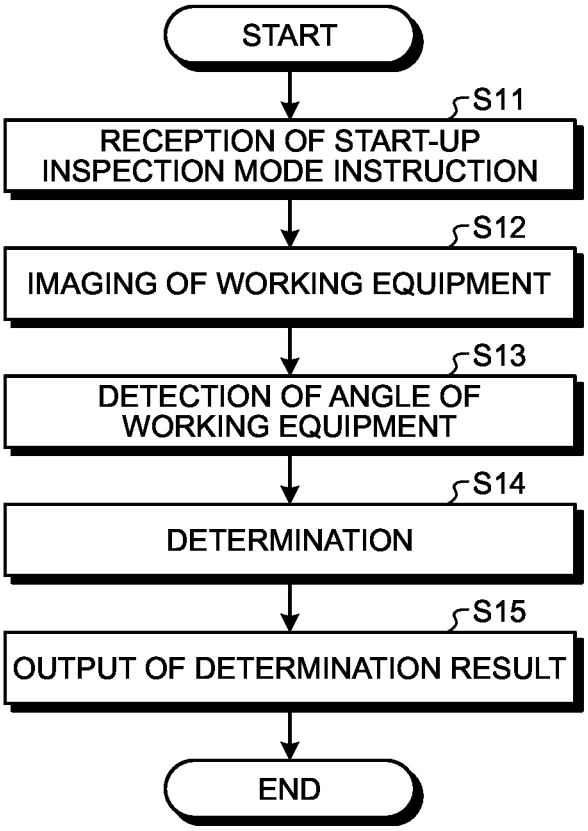
FIG. 8 is a flowchart illustrating an abnormality determination method applicable to the work machine according to the present embodiment.

FIG. 8 is a flowchart illustrating an abnormality determination method applicable to the wheel loader 1 according to the present embodiment. At the start-up of operation using the wheel loader 1, the wheel loader 1 is activated by the driver in a start-up inspection mode via an operation unit (not illustrated).

The control device 80 receives a start-up inspection mode instruction by an operation receiving unit (not illustrated) (Step S11). The control device 80 proceeds to Step S12.

When performing the start-up inspection mode, the driver performs an operation of raising and lowering the working equipment 10 of the wheel loader 1.

The working equipment 10 is imaged (Step S12). More specifically, the stereo camera 22 measures the front. Measurement data obtained by the stereo camera 22 is output to the measurement data acquisition unit 81 of the control device 80. The control device 80 uses the measurement data acquisition unit 81 to acquire image data obtained by capturing the front of the vehicle body 2 including the working equipment 10 imaged by the stereo camera 22. The image data including the working equipment 10 acquired by the measurement data acquisition unit 81 is output to the determination unit 91. The control device 80 proceeds to Step S13.

The angle of the working equipment 10 is detected (Step S13). The angle sensor 50 detects an angle of the working equipment 10 at the time of imaging by the stereo camera 22. The angle data indicating the angle of the working equipment 10 is output to the position data calculation unit 83 and the determination unit 91 of the control device 80. In the control device 80, the position data calculation unit 83 calculates position data indicating the posture of the working equipment 10 based on the angle data detected by the angle sensor 50. The position data calculated by the position data calculation unit 83 is output to the determination unit 91. The control device 80 proceeds to Step S14.

Such processing in Steps S12 and S13 is performed during the raising/lowering motion of the working equipment 10. For example, the processing may be performed repeatedly at predetermined time intervals during the raising/lowering motion of the working equipment 10. For example, the processing may be performed in a case where the working equipment 10 reaches a predetermined position during the raising/lowering motion of the working equipment 10. For example, the processing may be performed repeatedly during the raising/lowering motion of the working equipment 10 in a case where the working equipment illustrated in FIG. 7 is present within the predetermined region A1 and the predetermined angle A2.

The control device 80 uses the determination unit 91 to determine the presence or absence of abnormality (Step S14). In the present embodiment, the control device 80 uses the determination unit 91 to compare the estimated position of the working equipment 10 in the measurement data and the position of the working equipment 10 in the measurement data, defined from the posture of the working equipment 10 when captured by the stereo camera 22 so as to determine whether the mounting position of the stereo camera 22 is normal. More specifically, the position data calculation unit 83 estimates a range in which the bucket 12 is captured in the image data 100 based on the position data of the working equipment and the dimensional data of the working equipment 10. In a case where the bucket 12 is captured at the estimated position of the bucket 12 in the image data, the determination unit 91 determines that the stereo camera 22 is normal. In a case where the bucket 12 is not captured in the estimated position of bucket 12 in the image data, the determination unit 91 determines that the stereo camera 22 is not normal. The control device 80 proceeds to Step S15.

A case where Steps S12 and S13 are executed a plurality of times and the stereo camera 22 has captured a plurality of pieces of image data will be described. In this case, the determination unit 91 determines whether the mounting position of the stereo camera 22 is normal for each image data. It is allowable to make a determination in which the determination unit 91 determines that the stereo camera 22 is not normal in a case where it is determined that the predetermined ratio or more is not normal.

The control device 80 uses the output control unit 92 to output the determination result of the determination unit 91 (Step S15). In the present embodiment, the control device 80 controls to output a warning sound from the buzzer 7 controls to allow the lamp 8 to blink on/off in a case where the output control unit 92 determines that there is an abnormality. The control device 80 controls to turn the lamp 8 to steady-on in a case where the output control unit 92 determines that the state is normal. The control device 80 ends the processing.

[Computer System]

Figure 9:
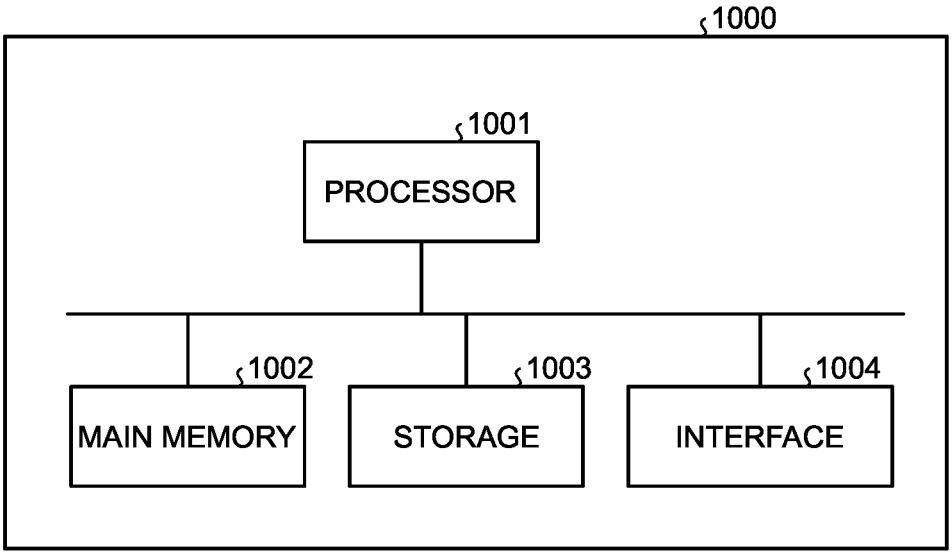
FIG. 9 is a block diagram illustrating an example of a computer system.

FIG. 9 is a block diagram illustrating an example of a computer system 1000. The control device 80 described above is constituted with a computer system 1000. The computer system 1000 includes: a processor 1001 such as a central processing unit (CPU); main memory 1002 including non-volatile memory such as read only memory (ROM) and volatile memory such as random access memory (RAM); storage 1003; and an interface 1004 including an input/output circuit. The functions of the control device 80 described above are stored in the storage 1003 as a program. The processor 1001 reads the program from the storage 1003, expands the program to the main memory 1002, and executes the above-described processes according to the program. The program may be delivered to the computer system 1000 via a network.

[Effects]

As described above, in the present embodiment, it is possible to determine whether the three-dimensional measurement device 20 is normal based on the estimated position of the working equipment 10 in the measurement data obtained by the measurement using the three-dimensional measurement device 20 defined from the posture of the working equipment 10 when measured by the three-dimensional measurement device 20. According to the present embodiment, it is possible to appropriately determine whether the three-dimensional measurement device 20 used for measuring the position of the working equipment 10 of the wheel loader 1 is normal.

In the present embodiment, it is possible to determine whether the three-dimensional measurement device 20 is normal, whether the angle sensor 50 is normal, and whether the input of the dimensional data is appropriate based on the determination of whether the positional relationship of the working equipment 10 based on the three-dimensional measurement device 20 and the angle sensor 50 is normal.

For example, in a case where it is determined that the positional relationship of the working equipment 10 based on the three-dimensional measurement device 20 and the angle sensor 50 is normal, it is possible to confirm that all conditions are satisfied, specifically, the mounting posture of the stereo camera 22 as a unit is appropriate, the relative posture of the stereo camera 22 between the first camera 22A and the second camera 22B is appropriate, the mounting posture of the boom angle sensor 51 and the bucket angle sensor 52 of the angle sensor 50 is appropriate, and the dimensional data has been appropriately input.

For example, in a case where it is determined that the positional relationship of the working equipment 10 based on the three-dimensional measurement device 20 and the angle sensor 50 is abnormal, it is possible to determine that the factor of abnormality is at least one of the following: occurrence of deviation in the mounting posture of the stereo camera 22 as a unit; occurrence of deviation in the relative posture of the stereo camera 22 between the first camera 22A and the second camera 22B; occurrence of deviation in the mounting posture of the boom angle sensor 51 or the bucket angle sensor 52 of the angle sensor 50; or incorrect dimensional data.

For example, in a case where it is determined that both the right stereo camera 22 and the left stereo camera 22 are abnormal, it can be determined that there is an abnormality in a portion other than the stereo camera 22. For example, in a case where it is determined that there is an abnormality in either one of the right stereo camera 22 or the left stereo camera 22, it can be determined that there is an abnormality in the stereo camera 22.

In the present embodiment, it is possible to more appropriately determine whether the three-dimensional measurement device 20 is normal based on the estimated position of the working equipment 10 in the measurement data defined from the posture of the working equipment 10 and the dimensional data of the working equipment 10 when measured by the three-dimensional measurement device 20.

In the present embodiment, the dimensional data to be used is position data of a plurality of positions on the outer periphery of the working equipment 10. In the present embodiment, the outer shape of the working equipment 10 can be appropriately defined. In the present embodiment, position data of five positions on the outer periphery of the working equipment 10 is used as the dimensional data. This makes it possible for the present embodiment to more appropriately define the outer shape of the working equipment 10.

In the present embodiment, determination is made in a case where the working equipment 10 is present within a predetermined region and within a predetermined angle, making it possible to suppress occurrence of erroneous detection of the vehicle body 2, buildings and obstacles around the work site, and the like by the three-dimensional measurement device 20. According to the present embodiment, determination can be made excluding a state in which the bucket 12 is not captured in the image data imaged by the three-dimensional measurement device 20.

In the present embodiment, it is possible to determine whether the mounting position of the three-dimensional measurement device 20 is normal by comparing the estimated position of the working equipment 10 in the measurement data and the position of the working equipment 10 in the measurement data defined from the posture of the working equipment 10 when measured by the three-dimensional measurement device 20.

In the present embodiment, position data indicating the posture of the working equipment 10 is calculated based on the detection result from the angle sensor 50. In the present embodiment, the posture of the working equipment 10 can be appropriately calculated.

The present embodiment makes it possible to determine whether the positional relationship of the working equipment 10 based on the three-dimensional measurement device 20 and the angle sensor 50 is normal. According to the present embodiment, it is possible to determine whether the three-dimensional measurement device 20 and the angle sensor 50 are normal.

The present embodiment makes it possible to make a determination based on the estimated position of the working equipment 10 in the measurement data defined from the posture of the working equipment 10 and the working equipment data stored in the storage unit 82 when measured by the three-dimensional measurement device 20. According to the present embodiment, determination can be made more appropriately.

The present embodiment makes it possible to output the determination result by using the buzzer 7 or the lamp 8, for example.

Other Embodiments

In each of the above-described embodiments, the three-dimensional measurement device 20 is not limited to the stereo camera 22, and may be a camera or a laser scanner, for example. The stereo camera 22 may be disposed on either the right side or the left side of the vehicle body 2. The arrangement of the stereo camera 22 illustrated in FIG. 1 is an example, and may be arranged at other places.

The work site where the wheel loader 1 performs work may be a mining site, a building site, or a construction site.

The wheel loader 1 may be used for snow removal work, work in an agricultural and livestock industry, or work in forestry.

In the above-described embodiment, the bucket 12 may have a plurality of blades or may have a straight blade edge.

The work member connected to the distal end of the boom 11 need not be the bucket 12, and may be a snow plow or a snow bucket used for snow removal work, a bale grab or a fork used for work of agriculture and livestock industry, or a fork or a bucket used for work of forestry.

The angle sensor 50 may include either one of the boom angle sensor 51 or the bucket angle sensor 52.

Instead of the lamp 8, a monitor (not illustrated) set in the wheel loader 1 can be used to display the determination result. The wheel loader 1 need not be equipped with all of the buzzer 7, the lamp 8, and the monitor. It is sufficient that the wheel loader 1 include one or more of the devices. Alternatively, the buzzer 7, the lamp 8, and the monitor may be provided outside the wheel loader 1.

In the control system 200 according to the above-described embodiment, a part of the configuration constituting the control system 200 may be mounted inside the work machine 1, and the other configurations may be provided outside the work machine 1. In addition, the control system 200 according to the above-described embodiment is supposed to include the working equipment 10, the three-dimensional measurement device 20, the angle sensor 50, the travel operation device 40, the buzzer 7, the lamp 8, and the control device 80. However, the configuration is not limited thereto, and some configurations may be omitted. As an example, it is possible to provide the control system 200 not including the buzzer 7 or the lamp 8.

The control device 80 according to the above-described embodiment may be constituted with a single computer, or configurations of the control device 80 may be divided into a plurality of computers, and the plurality of computers may function as the control device 80 in cooperation with each other.

The work machine 1 is not limited to the wheel loader, and the control device 80 and the abnormality determination method described in the above embodiment can also be applied to a work machine having working equipment such as an excavator or a bulldozer.

REFERENCE SIGNS LIST

1 WHEEL LOADER (WORK MACHINE)
2 VEHICLE BODY
2F VEHICLE BODY FRONT PORTION
2R VEHICLE BODY REAR PORTION
3 CAB
4 TRAVELING DEVICE
4A DRIVING DEVICE
4B BRAKING DEVICE
4C STEERING DEVICE
5 WHEEL
5F FRONT WHEEL
5R REAR WHEEL
6 TIRE
6F FRONT TIRE
6R REAR TIRE
7 BUZZER (OUTPUT UNIT)
8 LAMP (OUTPUT UNIT)
9 JOINT MECHANISM
10 WORKING EQUIPMENT
11 BOOM
12 BUCKET
12B DISTAL END
13 BOOM CYLINDER
14 BUCKET CYLINDER
15 BELL CRANK
16 LINK
THREE-DIMENSIONAL MEASUREMENT DEVICE
22 STEREO CAMERA
22A FIRST CAMERA
22B SECOND CAMERA
30 TRANSMISSION DEVICE
40 TRAVEL OPERATION DEVICE
50 ANGLE SENSOR (ANGLE DETECTION UNIT)
51 BOOM ANGLE SENSOR
52 BUCKET ANGLE SENSOR
80 CONTROL DEVICE
81 MEASUREMENT DATA ACQUISITION UNIT
82 STORAGE UNIT
83 POSITION DATA CALCULATION UNIT (POSITION CALCULATION UNIT)
86 TARGET CALCULATION UNIT
87 WORKING EQUIPMENT CONTROL UNIT
88 TRANSMISSION CONTROL UNIT
89 TRAVEL CONTROL UNIT
91 DETERMINATION UNIT
92 OUTPUT CONTROL UNIT
100 IMAGE DATA
200 CONTROL SYSTEM (ABNORMALITY DETERMINATION SYSTEM)
BE VESSEL (LOADING TARGET)
DS NATURAL HILL (EXCAVATION TARGET)
FX ROTATION AXIS
LS HAUL VEHICLE
RX ROTATION AXIS
RS GROUND SURFACE

The invention claimed is:

1. An abnormality determination system of a work machine, the system comprising:

a processor, and a camera mounted on the work machine having working equipment;

the processor being configured to:

estimate a position of the working equipment in a captured image of the camera based on a posture of the working equipment when captured by the camera; and determine the camera being normal in a case where an estimated position of the working equipment in the captured image defined from a posture of the working equipment when captured by the camera matches an actual position of the working equipment in the captured image, or in a case where a deviation is within a predetermined range, and determine the camera being not normal in a case where the estimated position of the working equipment in the captured image defined from the posture of the working equipment when captured by the camera does not match the actual position of the working equipment in the captured image, or in a case where the deviation is outside the predetermined range.

2. The abnormality determination system of the work machine according to claim 1, wherein the processor estimates the position of the working equipment in the captured image based on a posture of the working equipment when captured by the camera and dimensional data of the working equipment.

3. The abnormality determination system of the work machine according to claim 2, wherein the dimensional data is position data of a plurality of positions on an outer periphery of the working equipment.

4. The abnormality determination system of the work machine according to claim 3, wherein the dimensional data is position data of five positions on the outer periphery of the working equipment.

5. The abnormality determination system of the work machine according to claim 1, wherein the processor makes the determination in a case where the working equipment is present within a predetermined region and within a predetermined angle.

6. The abnormality determination system of the work machine according to claim 1, wherein the processor determines whether a mounting position of the camera is normal.

7. The abnormality determination system of the work machine according to claim 1, further comprising:

an angle sensor that is mounted on the working equipment and detects the posture of the working equipment; and wherein the processor calculates position data indicating the posture of the working equipment based on a detection result from the angle sensor.

8. The abnormality determination system of the work machine according to claim 7, wherein the processor determines whether the camera and the angle sensor are normal.

9. The abnormality determination system of the work machine according to claim 8, wherein the processor determines whether a positional relationship of the working equipment based on the camera and the angle sensor is normal.

10. The abnormality determination system of the work machine according to claim 1, wherein the processor stores working equipment data including dimensional data and shape data of the working equipment, and wherein the processor makes the determination based on an estimated position of the working equipment in the captured image, the estimated position being defined by the posture of the working equipment when captured by the camera and by the working equipment data.

11. The abnormality determination system of the work machine according to claim 1, wherein the processor outputs a determination result of the determination unit.

12. The abnormality determination system of the work machine according to claim 11, wherein output is performed by a buzzer.

13. The abnormality determination system of the work machine according to claim 11, wherein output is performed by a lamp.

14. An abnormality determination method applicable to a work machine, the method comprising:

estimating a position of working equipment in a captured image obtained by a camera mounted on the work machine including the working equipment based on a posture of the working equipment when captured by the camera; and determining the camera being normal in a case where an estimated position of the working equipment in the captured image defined from a posture of the working equipment when captured by the camera matches an actual position of the working equipment in the captured image, or in a case where a deviation is within a predetermined range, and determining the camera being not normal in a case where the estimated position of the working equipment in the captured image defined from the posture of the working equipment when captured by the camera does not match the actual position of the working equipment in the captured image, or in a case where the deviation is outside the predetermined range.

15. The abnormality determination method applicable to the work machine according to claim 14, wherein the position of the working equipment in the captured image is estimated based on a posture of the working equipment captured by the camera and dimensional data of the working equipment.

* * * * *